United States Patent [19]

Ureta

[11] 3,964,196

[45] June 22, 1976

[54] SCHELENDAR

[76] Inventor: Luis A. Ureta, 1116½ S. Menlo Ave., Los Angeles, Calif. 90006

[22] Filed: June 4, 1975

[21] Appl. No.: 570,275

[52] U.S. Cl. ..... 40/107
[51] Int. Cl.[2] ..... G09D 3/00
[58] Field of Search ..... 40/107, 109, 110, 111, 40/113, 114, 115, 119, 122; 283/2, 3

[56] References Cited

UNITED STATES PATENTS 384,526 6/1888 Isbell ..... 40/107
1,988,782 1/1935 Canepa ..... 40/107

FOREIGN PATENTS OR APPLICATIONS 654,085 5/1963 Italy ..... 40/107

*Primary Examiner*—Louis G. Mancene
*Assistant Examiner*—John H. Wolff

[57] ABSTRACT

The disclosure relates to an activity schedule display device suitable for visually displaying work or activity schedules and relating them to the time of day.

4 Claims, 9 Drawing Figures

SCHELENDAR

The Schelendar, circular in shape or in any geometrical shape, hollow, solid or built-up, made either of wood, composite wood, cardboard or similar material (with or without plastic lamination), cloth or similar material, metal, hard rubber, plastic or similar moulding material or other materials, with the following illustrations done by either printing, painting, etching, photographic process or a combination of the preceding methods and other similar processes:

a. Face of a clock (with or without clock mechanism);

b. Seven circular (or in any geometrical shape) figures representing the seven days of the week, divided into twenty-four divisions signifying the twenty-four hours of the day, also indicating day and night;

c. Pictures of the different activities of a person (man, woman or child), from kindergarten age to adult, such as breakfast, lunch, school, play, study, TV program, cook, housework, market, laundry, beauty shop, sleep, wake, hobby, exercise, picnic, church, doctor, social, sports, family, bank, meeting, office, etc.;

d. A standard calendar, showing the present month, preceding month and following month, which is printed separately and attached by means of a clip or similar attaching method, replaceable yearly; and e. An adjustable calendar giving the month, day and date.

Every activity is represented by a corresponding pin (plastic, or metal) or self-adhesive decal or similar marking device, which is placed on the hour of the hour division of the seven days circular figures (see FIG. 4-Q), showing what activity is scheduled on such hour of the day.

In the drawings,

FIG. 1 shows the full Front View of the Schelendar in the circular form. (A) face of the conventional clock or a 24-hour clock, (B) one of the seven figures representing the seven days of the week (see enlargement- FIG. 4), (C) SCHELENDAR — name of the invention, (D) name of the user — to be printed after or upon purchase, (E) activities of a person (man, woman or child) in illustration (see enlargement- FIG. 5), (F) interchangeable leaves (metal, plastic, etc.) showing the month, (G) interchangeable leaves (metal, plastic, etc.) showing the day, (H) present month of the calendar (printed and replaceable yearly), (I) preceding month, (J) following month, (K) interchangeable leaves showing the date (metal, plastic, etc.).

Figure 1:
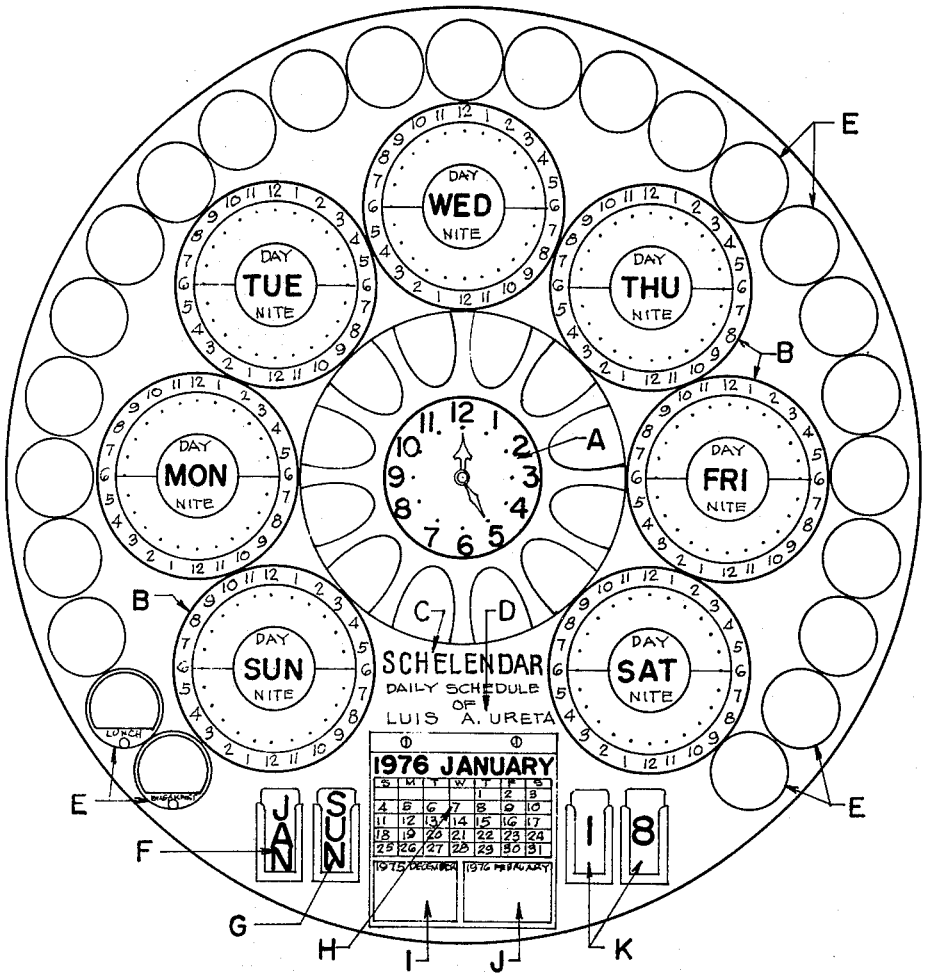
Figures 2, 3:
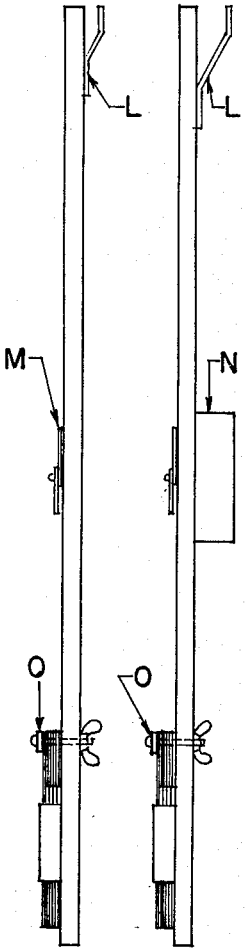
FIG. 2 shows the Side View of the Schelendar without the clock mechanism, (L) hanger (metal or plastic), (M) movable short and long hand of a clock, and (O) clip for the printed and replaceable calendar.
FIG. 3 shows the Side View of the Schelendar with the clock mechanism, (N) clock mechanism (battery, electric or spring powered.
Figure 4:
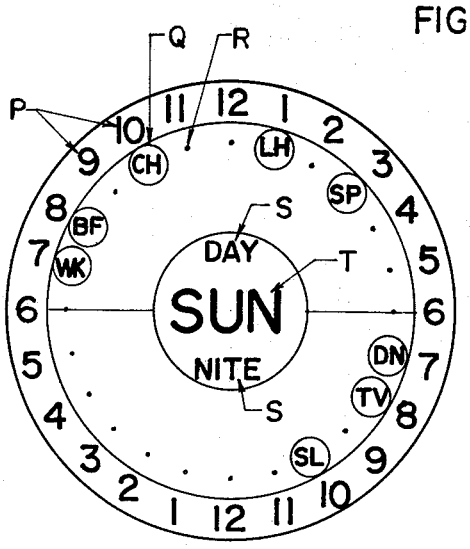
FIG. 4 shows the enlargement of (B) in FIG. 1, Front View of one of the seven figures representing the seven days of the week (24 hour clock), (P) time of the day, (Q) pin or decal with letter symbols of the different activities of a person, (R) pin holes where pins be located (if pins will be used), (S) shows day or night, and (T) shows the day (Mon, Tue, Wed, etc.).
Figure 5:
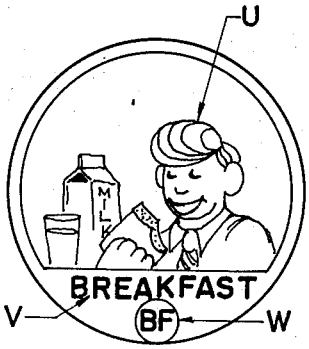
FIG. 5 shows the enlargement of (E) in FIG. 1, different activities of man, woman or child, (U) illustration of the activity — breakfast, lunch, etc., (V) name of the activity, and (W) symbol for the activity.
Figures 8, 9:
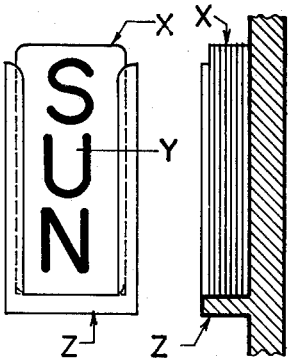
Figure 6:
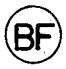
FIG. 6 shows the Top View of self-adhesive decal or pin with the activity symbol.
Figure 7:
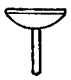
FIG. 7 shows the Side View of the pin with the activity symbol.

FIG. 8 enlargement of (F), (G) and (K), showing the leaves with its corresponding letterings, (X) interchangeable leaves, (Y) month, day or date, and (Z) the housing for the interchangeable leaves.

FIG. 9 shows the Section of the housing.

I claim:

1. An activity schedule display device comprising: a display board having seven discrete schedule areas thereon, each schedule area having indicia thereon representing a different day of the week and each schedule area further having indicia representing the time in hourly increments from beginning to end of the day each of said increments being associated with engaging means, said board further having a plurality of discrete activity indicating areas thereon each provided with both a pictorial and a symbolic representation of an indicated activity; a plurality of activity pin-like elements each having a symbolic representation of an indicated activity on one side thereof, and means on the opposite side whereby each of said elements is adapted to engage with a selected one of said engaging means; and, a clock is mounted on said board, whereby, the clock permits correlation between a time frame and an indicated activity.

2. A device according to claim 1 wherein said clock is centrally arranged on said board and said schedule areas are circularly arranged around said clock.

3. A device according to claim 2 wherein said activity indicating areas are circularly arranged around said schedule areas.

4. A device according to claim 3 wherein a calendar having date, month and year indicia is mounted on said board.

* * * * *